US008471726B2

(12) United States Patent
Ekmark et al.

(10) Patent No.: US 8,471,726 B2
(45) Date of Patent: Jun. 25, 2013

(54) SYSTEM AND METHOD FOR COLLISION WARNING

(75) Inventors: Jonas Ekmark, Olofstorp (SE); Mattias Erik Brannstrom, Gothenburg (SE); Jonas Lars Zakarias Jansson, Linkoping (SE); Erik Coelingh, Alvangen (SE)

(73) Assignee: Volvo Car Corporation, Goeteborg (SE)

( * ) Notice: Subject to any disclaimer, the term of this patent is extended or adjusted under 35 U.S.C. 154(b) by 373 days.

(21) Appl. No.: 13/037,757

(22) Filed: Mar. 1, 2011

(65) Prior Publication Data

US 2011/0215947 A1 Sep. 8, 2011

(30) Foreign Application Priority Data

Mar. 3, 2010 (EP) ..... 10155320

(51) Int. Cl.
*G08G 1/00* (2006.01)

(52) U.S. Cl.
USPC ..... 340/902; 340/901; 340/933; 340/904; 340/435; 340/436

(58) Field of Classification Search
USPC ..... 340/901, 902, 904, 905, 933, 435, 340/436
See application file for complete search history.

(56) References Cited

U.S. PATENT DOCUMENTS

| | | | | |
|---|---|---|---|---|
| 2007/0018800 | A1 | 1/2007 | Boss et al. | |
| 2007/0237027 | A1* | 10/2007 | Sugiura et al. | 367/96 |
| 2008/0147277 | A1* | 6/2008 | Lu et al. | 701/45 |
| 2009/0050394 | A1* | 2/2009 | Takahashi et al. | 180/274 |
| 2009/0216408 | A1* | 8/2009 | Ueno | 701/45 |
| 2011/0040452 | A1* | 2/2011 | Tsunekawa et al. | 701/45 |
| 2011/0285175 | A1* | 11/2011 | Imamura | 296/193.05 |
| 2012/0188098 | A1* | 7/2012 | Mochizuki | 340/905 |

FOREIGN PATENT DOCUMENTS

EP 1020834 A2 7/2000

* cited by examiner

*Primary Examiner* — Daryl Pope
(74) *Attorney, Agent, or Firm* — Brooks Kushman P.C.

(57) ABSTRACT

A system and method for collision warning in a host vehicle including: detecting a collision risk between the host vehicle and an other user of the road with a detection means based on input from at least one sensor which detects at least one parameter related to the other user of the road with respect to the host vehicle; identifying possible options to avoid a collision between the host vehicle and the other user of the road based on input from the detection means, wherein possible options for the host vehicle to avoid a collision are identified as well as possible options for the other user of the road to avoid a collision are identified; calculating among the identified possible options at least one preferred avoidance action in order to avoid a collision between the host vehicle and the other user of the road; and if the at least one preferred avoidance action involves at least one possible option identified for the other user of the road, then generating a warning signal from the host vehicle in a direction towards the other user of the road in order to warn the other user of the road of the collision risk.

20 Claims, 5 Drawing Sheets

SYSTEM AND METHOD FOR COLLISION WARNING

CROSS-REFERENCE TO RELATED APPLICATIONS

This application claims foreign priority benefits under 35 U.S.C. §119(a)-(d) to EP 10155320.4, filed Mar. 3, 2010, which is hereby incorporated by reference in its entirety.

TECHNICAL FIELD

The present invention concerns a system and method for collision warning in a host vehicle. More particularly the present invention relates to a system and method for collision warning, which system has detected a collision risk based on input from at least one sensor which detects at least one parameter related to another user of the road with respect to the host vehicle. The invention is intended for use particularly but not exclusively in a passenger car, a bus and a heavy goods vehicle but is applicable to any other vehicle such as a truck or a snow plough.

BACKGROUND

Road traffic accidents are one of the world's largest public health problems. In the EU alone, traffic accidents cause approximately 1.8 million injuries and 43.000 fatalities each year. Many, but not yet all, of today's modern vehicles are provided with active safety systems that may assist the driver in his/her driving. Active safety is defined as technologies that can detect hazardous traffic situations and actively assist road users in avoiding or mitigating accidents. These systems may include for example anti-spin systems but also more sophisticated systems that may assist the driver in controlling the vehicle and monitor the surrounding traffic, such as other vehicles or road users but also other objects or obstacles that may occur on the road. Some of these systems use proximity sensors for monitoring the state of surrounding road and/or users of the road. These active safety systems may for example provide for automatic activation of brakes and/or steering and warn the driver of a registered collision risk.

In US2007/0021915A1, a system for avoiding collisions between a vehicle and another object is described. In this system an information unit comprising a transmitter/receiver is arranged on a host vehicle. The transmitter/receiver transmits and receives radio waves from a transmitter of each other vehicle within transmission range. A position determining device and a processor is further arranged on the host vehicle. The incoming information to the system is analyzed to ascertain whether a collision between the host vehicle and any of the other vehicles is likely to occur. Actions taken by the system could be activation of a driver notification system to alert the driver of the collision risk or activation of a vehicle control system, such as braking or steering of the vehicle to avoid a collision. A drawback with the described system is that it requires that all involved vehicles are provided with transmitter/receivers.

Accidents are often caused by a combination of coincidences, rather than by one single event. Since there are several contributing factors for each accident, this also implies that there are several possibilities for preventing accidents. However, there may occur situations in which a driver of a vehicle has no or very little possibility to act despite an active safety system in the vehicle that may either warn and/or instruct the driver to take action or which automatically takes action to avoid a potential threat to the own vehicle and/or other road users. Further, today the majority of the vehicles that are out on the roads are not equipped with an active safety system. This means that even if one vehicle detects a collision risk with another vehicle, it may not have a possibility to act.

Accordingly, there is a need for improvements in the field of collision warning systems for motor vehicles.

SUMMARY

An object of the present invention is to overcome or ameliorate at least one of the disadvantages of the prior art.

A further object may be to improve the possibility of avoiding a detected collision risk between a host vehicle and another user of the road involved in the detected collision risk.

A still further object may be to provide an improved method and system for collision warning in situations where the freedom of action is limited for at least one of the users of the road.

At least one of the objects is achieved by a method for collision warning in a host vehicle, which method comprises the steps of:

detecting a collision risk between the host vehicle and an other user of the road with a detection means, based on input from at least one sensor which detects at least one parameter related to the other user of the road with respect to the host vehicle, identifying possible options to avoid a collision between the host vehicle and the other user of the road based on input from the detection means, wherein possible options for the host vehicle to avoid a collision are identified as well as possible options for the other user of the road to avoid a collision are identified, calculating among the identified possible options a preferred avoidance action in order to avoid a collision between the host vehicle and the other user of the road, and if the preferred avoidance action involves at least one possible option identified for the other user of the road, then generating a warning signal from the host vehicle in a direction towards the other user of the road in order to warn the other user of the road of the collision risk.

It may be an advantage in the method that possible options for avoiding a collision are evaluated for both a host vehicle and another user of the road. The generation of a warning signal towards the other user of the road is then performed if the other user of the road may contribute in avoiding a collision. The chances to avoid a collision may thus increase if another road user that has been identified to have a possibility to avoid a collision is warned about a collision risk.

A further advantage with the method may be that when a host vehicle has only small or no possibilities to avoid a collision, the other user of the road involved in the situation may be warned about the collision risk and may thus act upon it in order to avoid a collision.

Therefore, by first performing an analysis to identify a preferred avoidance action for a detected collision risk involving the host vehicle as well as the other user of the road and then, secondly, by generating a warning to the other user of the road which has been identified to have a possibility to act and thereby avoid a collision, an improved collision warning method is provided for.

It may be realized that the method may be applied in a range of different collision risk scenarios involving a host vehicle and a cyclist, a pedestrian, an animal or an other motor vehicle. For example, in scenarios involving a host vehicle and at least one more motor vehicle, such as a passenger car, the collision scenario may be defined as a head-on collision, a side collision or a rear-end collision. Thus, a collision warning may be generated from the host vehicle in a direction defined from the front of the host vehicle. A collision warning may also be generated from the host vehicle in a direction defined from a side of the host vehicle. Further, a collision warning may be generated from the host vehicle in a direction defined from the rear end of the host vehicle. A collision warning may be also generated from the host vehicle in a direction defined from the front, a side and/or the rear end at the same time.

According to an embodiment of the method, it may comprise the step of generating a warning signal from the host vehicle in a direction defined from the front and/or a side of the host vehicle towards the other user of the road.

In this way, a generated warning signal from the host vehicle may be clearly noticed by another user of the road in the case of the collision risk being a front-to-front collision, but also in the case that the collision risk is a front-to-side collision, such as in a collision at an intersection, or in the case that the collision risk is a side-to-side collision, such as in for example a change of lane collision situation.

According to another embodiment, the method may comprise the step of connecting a warning signal generating means arranged with the host vehicle to a calculating means performing the calculating step for providing the warning signal in the form of an audible signal and/or a visible signal.

A warning signal generated towards a vehicle in relation to for example a detected head-on collision or a rear-end collision may preferably be a visible signal, as an audible signal may be difficult to perceive other than when the host vehicle is relatively close to the other user of the road. But in for example a changing lane situation, the host and the other road user are relatively close to each other and an audible signal is to be preferred, either in combination with the visible signal or alone.

According to another embodiment, the method may comprise the step of detecting a collision risk between the host vehicle and the other user of the road in a detection means, based on input from at least one sensor which detects also at least one environmental parameter with respect to said host vehicle.

It may be an advantage that account is taken to both environmental parameters such as weather conditions and features related to infrastructure on or close to the road, such as the presence road fences and/or shoulder, the type of road edge, condition of the road surface, lane markings and tire-to-road friction etc. Still further environmental parameters may be further other users of the road that are present within the detected area but that are not parts in the detected collision risk.

According to yet another embodiment, the method may comprise the step of detecting a collision risk between the host vehicle and the other user of the road in a direction defined from the front and/or a side of the host vehicle towards the other user of the road.

According to an embodiment, the method may comprise the step of detecting a collision risk between said host vehicle and said other user of the road wherein said other user of the road is detected to be another motor vehicle, a cyclist or a pedestrian.

At least one of the above mentioned objects is achieved by a system for collision warning in a host vehicle, comprising a detection means for detecting a collision risk between the host vehicle and an other user of the road, based on input from at least one sensor which detects at least one parameter related to the other user of the road with respect to the host vehicle, an identifying means for identifying possible options to avoid a collision between the host vehicle and the other user of the road based on input from the detection means, wherein possible options for the host vehicle to avoid a collision are identified as well as possible options for the other user of the road to avoid a collision are identified, a calculating means for calculating among the identified possible options a preferred avoidance action in order to avoid a collision between the host vehicle and the other user of the road, and, a warning signal generating means for generating a warning signal from the host vehicle in a direction towards the other user of the road if the preferred avoidance action involves a possible option identified for the other user of the road.

According to an embodiment the system further comprises that the warning signal generating means is connected to the calculating means such that a warning signal can be automatically issued if the preferred avoidance action involves a possible option identified for the other user of the road.

According to another embodiment the means for generating a warning signal comprises means for providing an audible signal and/or a visible signal.

In many cases a visible warning signal may attract the attention of a driver of another vehicle such that he/she becomes aware of a detected collision risk. However, there are also scenarios in which the sight for the driver of another vehicle may be impaired or, for example in the case of a changing lane situation that the host vehicle is out of sight or when the host vehicle is positioned in a blind spot in relation to the other vehicle. In such a case it is an advantage that the warning signal is an audible signal or that the visible signal is combined with the audible signal.

According to yet another embodiment the means for generating an audible warning signal comprises the horn of the host vehicle.

According to an embodiment the means for generating a visible warning signal comprises at least one head light, tail light, stop tail light and/or indicator light of the host vehicle.

By using the horn, head lights, tail lights, stop tail lights and/or indicator lights that are provided on the host vehicle, parts that are already installed in a vehicle may be used for a second purpose.

An advantage with this may be that the described system may be installed in a vehicle and readily connected to parts and details that are already provided in the vehicle. Hence, a system as described herein requires relatively few parts.

According to an embodiment the means for generating a warning signal are positioned on the host vehicle to direct the warning signal out from the front and/or out from a side of the host vehicle.

According to another embodiment, the other user of the road is the driver of another motor vehicle, a cyclist or a pedestrian.

There is also presented a vehicle that comprises a system according to any of the above embodiments.

Further embodiments and advantages will be apparent from dependent claims and the following detailed description.

DEFINITIONS

As used herein, the expression "user of the road" relates to something or someone that resides on the road, the shoulder of the road or close to the road, with or without a moving direction, such as for example a vehicle, such as a cyclist, a motorcyclist, a passenger car, a truck, a heavy goods vehicle etc or a pedestrian or even an animal.

With the expression "a parameter related to the other user of the road" as used herein is meant a physical property such as the position of, the direction of movement of, the speed of, the size of the other user of the road.

With the expression "environmental parameter" as used herein, are meant conditions or structures of the road environment in the vicinity of the other user of the road and/or host vehicle, such as conditions of the road, paved or not, road fences, shoulders of the road, tire-to-road friction, lane markings etc, as well as weather conditions, such as temperature, rainfall or snowfall, fog, degree of daylight etc.

As used herein, the expression "avoidance action" relates an action performed or taken to avoid a detected collision risk. Such an avoidance action may involve changing lane, braking, accelerating, pull over to the side of the road, bringing the vehicle to a complete stop or steering. Further, in the process of calculating a preferred avoidance action it may be advantageous that both the host vehicle and the other user of the road take an action. Therefore, the expression "a preferred avoidance action" as used herein, may involve the host vehicle only, the other vehicle only for example if the host vehicle cannot or is hindered to take any action at all, or it may optionally involve an action from both the host vehicle and the other vehicle.

The expressions "front" and "rear" relate to the motor vehicle, where front is the part coming first in the normal forward driving direction and rear is the part defining the rear end of the vehicle. Further, the expression "side" as is used herein, relates to the part of a vehicle between the front and the rear.

BRIEF DESCRIPTION OF THE DRAWINGS

The present invention is pointed out with particularity in the appended claims. However, other features of the present invention will become more apparent and the present invention will be best understood by referring to the following detailed description in conjunction with the accompany drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The invention will be described using examples of embodiments. It should however be realized that the example embodiments are included in order to explain principles of the invention and not to limit the scope of the invention, defined by the appended claims.

Figure 1:
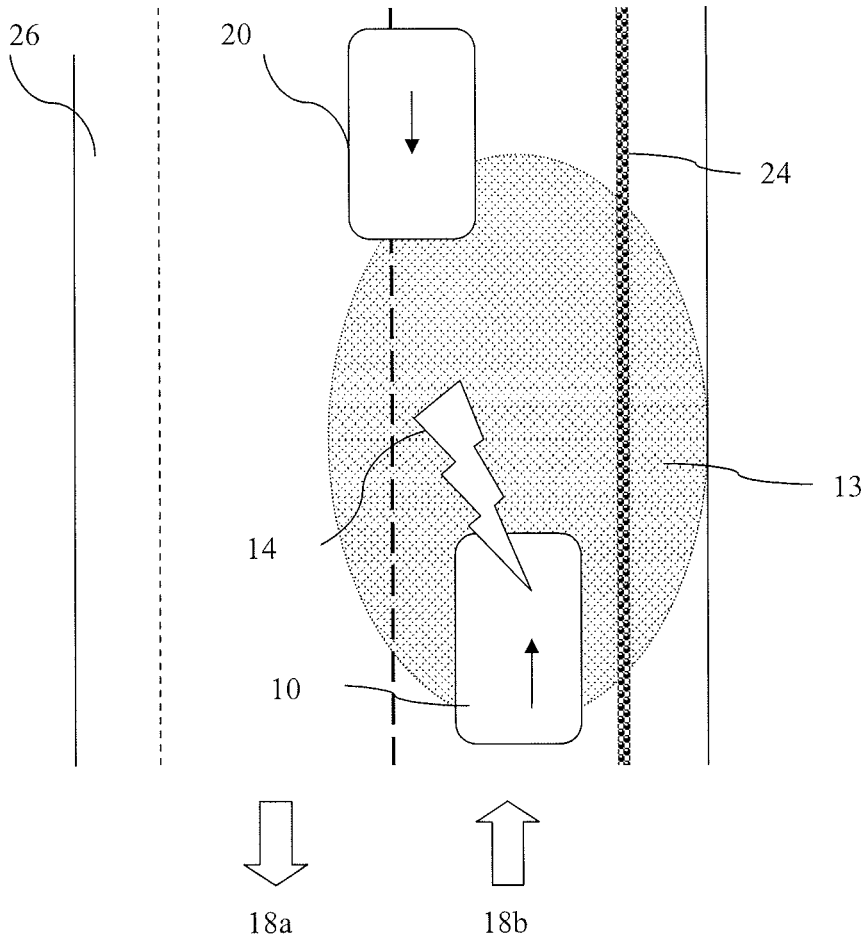
FIG. 1 shows in a schematic manner a host vehicle comprising a system according to an embodiment of the present invention travelling along the right hand lane of a road.

FIG. 1 shows a host vehicle 10, in the present case a passenger car provided with a system for collision warning according to the present invention. The host vehicle 10 is travelling along the right hand lane 18*b* of a two-lane road having one lane 18*b* in a first direction and a second lane 18*a* in the opposite direction. The driving directions are illustrated by block arrows. The two-lane road illustrated in FIG. 1 is further provided with a side fence 24 on the right hand side of the road. Normally a side fence is arranged at the road side to protect users of the road from hazards present at the road side, which for example could be a steep edge of the roadway, a riverbank or a cliff. The left hand side 18*a* of the two lane road has a shoulder 26.

When another user 20 of the road, e.g. another motor vehicle, appears in the left hand lane 18*a* of the road, the host vehicle may detect this other user of the road by means of at least one sensor (not shown). The host vehicle may also detect if there is a collision risk between the host vehicle 10 and the other user 20 of the road with a detection means which comprises or receives input from the at least one sensor from within a scanned area 13.

In the illustrated example of FIG. 1, the other user 20 of the road has for some reason crossed the centre line and is actually partly travelling in the wrong lane, i.e. the right hand lane 18*b* which is where the host vehicle is travelling. The presence of a collision risk is detected in the detection means from sensor data processed in the detection means and/or in the sensor which are compared with predetermined boundary conditions. To be able to scan a certain area 13 in the vicinity of the host vehicle, the detection means may for example comprise and/or receive information from at least one sensor (not shown in FIG. 1). A sensor may for example be a camera, radar sensors, ultrasonic or infrared devices or a combination thereof. The host vehicle may be provided with at least one sensor (not shown) located around the host vehicle so that the presence, position, size, speed of other users of the road anywhere within an area 13 of for example about 150 to 200 metres radius from the host vehicle may be detected.

As soon as a collision risk has been detected a process starts to identify different options to avoid a collision between the host vehicle 10 and another user 20 of the road or object. The possible options identified are based on input from the detection means together with predetermined boundary values in relation to the host vehicle. In the example illustrated in FIG. 1, it is for example detected that the other user of the road has a certain size and that it moves in a certain direction with a certain velocity. Moreover, at least one environmental parameter such as outside temperature, visibility, infrastructure of the road etc may be taken into account. Other environmental parameters that may be encountered in this illustrated case are the presence of a road fence 24 on the right hand side. In this way, possible options for the host vehicle to avoid a collision are identified as well as possible options for the other user of the road to avoid a collision are identified. All identified possible options to avoid a collision are directed to a calculating means and then a preferred avoidance action is calculated from the different identified possible options again together with predetermined boundary values related to the host vehicle.

In the illustrated example in FIG. 1, a preferred avoidance action may be that the other user 20 of the road actually returns to his/her proper lane 18*a*. This avoidance action is preferred as the host vehicle 10 as no or at least very limited options to avoid a collision. The possible options for the host vehicle 10 are limited as the side fence 24 makes it impossible to use the shoulder of the road. Further, the option to steer out into the left hand lane 18*a* implies the risk that still another vehicle may appear heading in the opposite direction in relation to the host vehicle. The other vehicle 20 on the other hand, may have at least one option to avoid a collision, for example, by returning to its proper lane 18*a*.

In this situation, the host vehicle has very limited possibilities to avoid a collision by itself but the other user of the road may still have a possibility. Therefore, a warning signal 14 is issued towards the other user 20 of the road. A warning generating means, such as head lights, indicator lights and/or a horn signal, is connected to the calculating means. This is further described in relation to FIG. 4 below.

Figure 2:
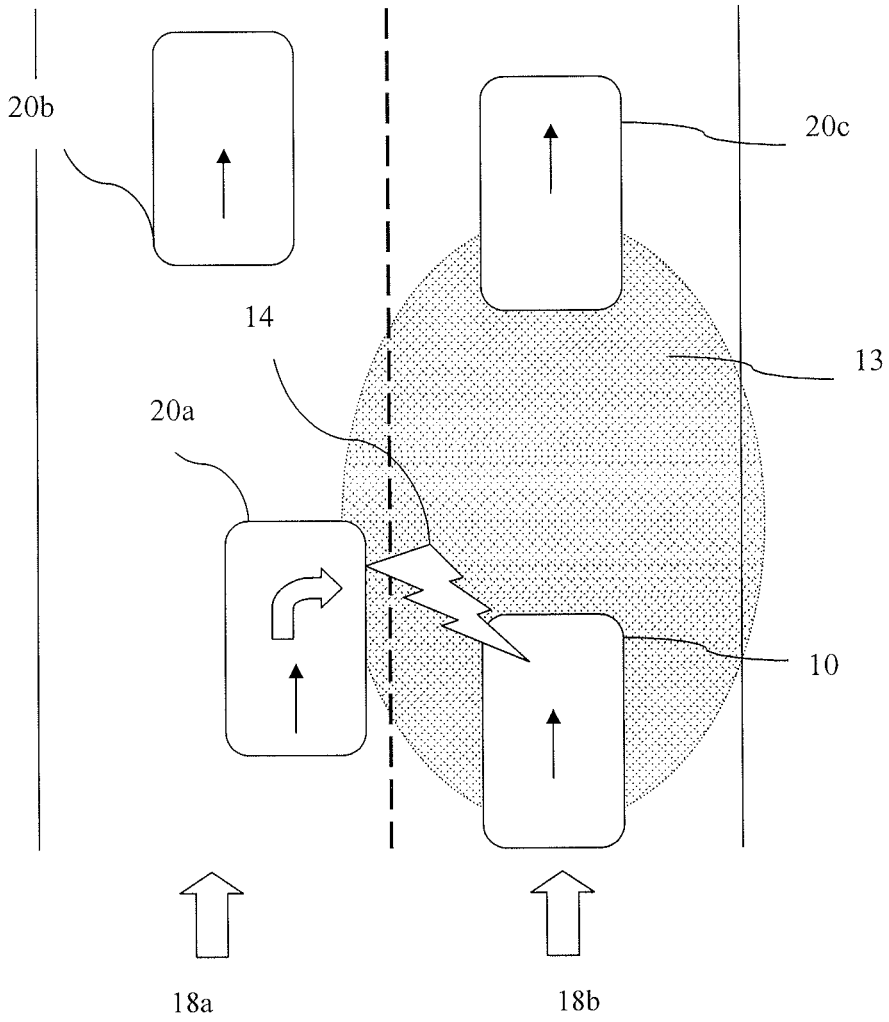
FIG. 2 shows in a schematic manner a host vehicle comprising a system according to an embodiment of the present invention, the host vehicle is approaching an intersection between a main road and another road.

FIG. 2 shows another example embodiment for the present system for collision warning in which a host vehicle is schematically illustrated driving in an inner lane of a two lane road. The host vehicle 10 is surrounded by three other 20*a*, 20*b*, 20*c* users of the road of which two are within the area 13 for detecting a collision risk. Similar to what has been described above in relation to FIG. 1, the host vehicle 10 is provided with a system according to the present invention which includes a detection means, a means for identifying possible option to avoid a collision for the two involved vehicles/users of the road and a calculating means. In FIG. 2, the host vehicle 10 has identified a collision risk with another user 20*a* of the road which has initiated a lane change, illustrated with a block arrow on the other user 20*a* of the road, but without realising that changing to the right hand lane 18*b* at the showed position in time would lead to a collision with the host vehicle. In this case, the system may identify that a preferred avoidance action may be for the other user 20*a* of the road to stay in the left hand lane 18*a* and thus interrupt the started lane change. By generating a warning signal 14 towards the other user 20*a* of the road by means of a visible and/or audible warning signal 14 such as sounding the horn, flashing the lights, preferably both head lights that are in the front of a host vehicle but preferably also indicator lights. Indicator lights are normally positioned at front and rear sides of a vehicle and/or on rear vision mirrors positioned at the sides of a vehicle, and would therefore attract the attention of a driver in another vehicle positioned at one of the sides of a host vehicle, which is the case in the illustrated example in FIG. 2.

Figure 3:
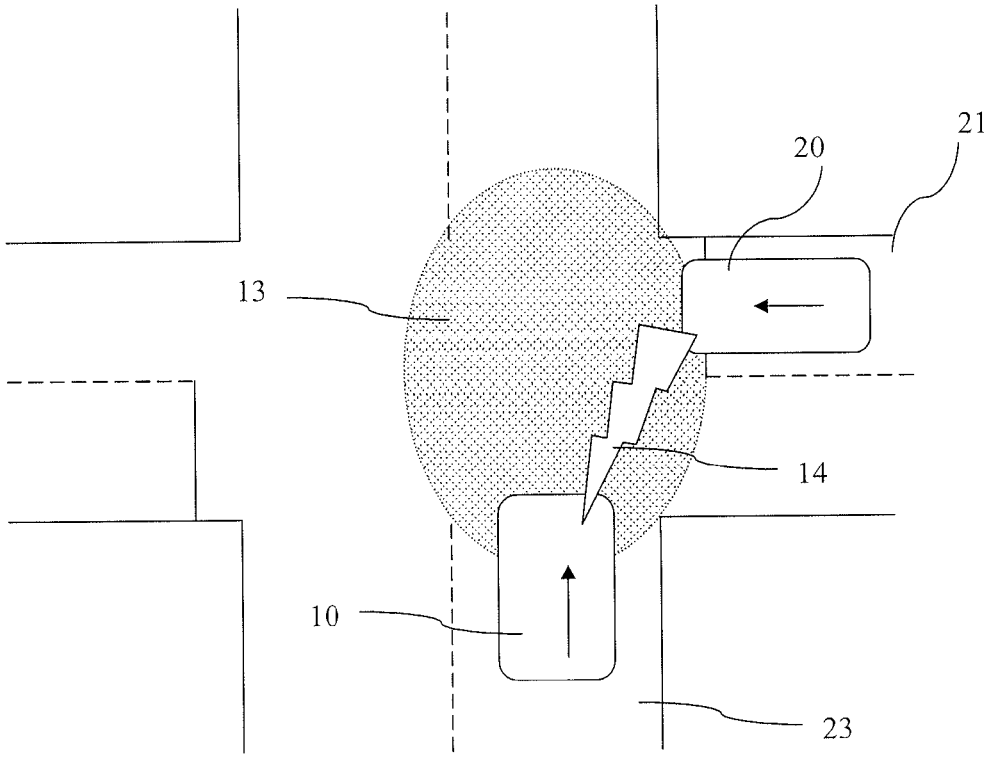
FIG. 3 shows in a schematic manner a host vehicle comprising a system according to an embodiment of the present invention, the host vehicle is travelling along the inner lane of a road.

In FIG. 3, a situation at an intersection is illustrated. A user 20 of the road driving along a smaller road 21 have to give way for traffic travelling along a larger road 23. However, a host vehicle 10 that is heading towards the intersection detects another user 20 of the road 21. The other user 20 of the road is moving in a direction into the middle of the intersection. Accordingly, a collision risk is detected by the host vehicle 10 within the detected area 13. The host vehicle identifies possible options for both vehicles to avoid a collision and calculates a preferred avoidance action. For example, one possible avoidance action could be that the host vehicle 10 used its brakes to lower its speed and/or came to a complete stop. However, depending on the speed of the host vehicle 10 when it enters the intersection, this may not be enough to avoid a collision and it would also be preferred that the other user 20 of the road performed an action. For example, an action for the other user 20 of the road could be to use the brakes such that its speed is lowered or that it stops. As one of the options involves the other user 20 of the road, the other user of the road 20 is warned about the collision risk by a warning signal 14 from the host vehicle 10.

Figure 4:
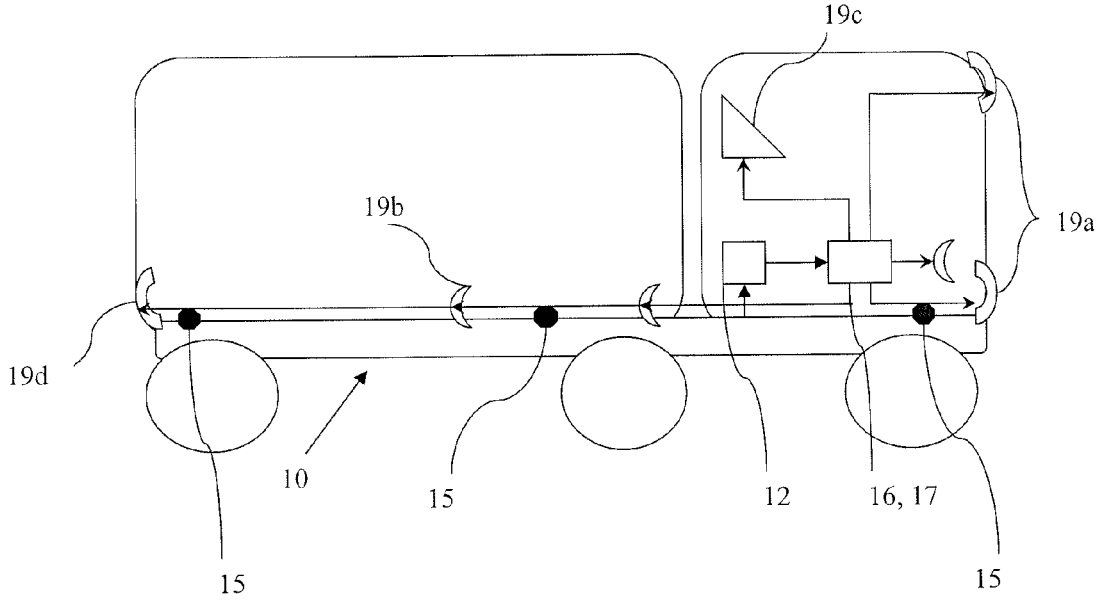
FIG. 4 shows a vehicle comprising the system according to the present invention.

In FIG. 4, a host vehicle 10, in this case a heavy loads vehicle, is schematically shown comprising a collision warning system according to the present invention. The system comprises detection means 12 receiving information from at least one sensor 15. The sensors 15 may detect objects, such as other users of the road, but also guard rails, lane markings, a road edge and stationary objects in a certain part or certain parts of the area around the host vehicle 10. Further, a sensor 15 may also measure data of the host vehicle such as speed, acceleration, yaw rate, tire-to-road friction etc. A combination of detected features of the host vehicle 10 itself and detected features from sensors 15 such as cameras, radar sensors, ultrasonic or infrared devices may be needed to determine or evaluate the situation in a satisfying way.

A potential collision risk is detected by the detection means 12 based on input from sensors 15 positioned on the host vehicle 10. It should be noted that the detection means 12 may comprise one or more sensors 15. The system further comprises an identifying means 16 and a calculating means 17. The identifying means 16 receives information from the detection means 12, which in turn has received information from one or more sensors 15, about a detected collision risk as well as other parameters of interest, such that possible options to avoid a collision may be identified. Other parameters of interest may be features of the host vehicle and/or environmental parameters. The calculating means 17 receives input from the identifying means 16 but also from the detection means 12 and/or one or more sensors 15. The calculating means uses this information together with pre-set boundary conditions, which may be what may actually be possible for the host vehicle to perform, to calculate at least one preferred avoidance action. The detection means 12 and calculating means 16 are connected to each other such that they may exchange information. It is to be noted that the identifying means 16 and the calculating means 17 may be arranged as one single unit but as well as two separate units. Further, the host vehicle 10 is provided with means 19*a*, 19*b*, 19*c*, 19*d* for generating a warning signal. Preferably, means for generating a warning signal are audible means 19*c* such as the horn 19*c* of the vehicle 10 and/or visible signal means 19*a*, 19*b*, 19*d*, such as head lights 19*a*, indicator lights 19*b* or stop tail lights/tail lights 19*d*. A vehicle may also have other means for generating a warning signal that are particularly arranged on the vehicle for issuing warning signals. It may for example be extra lights in different colours arranged on the sides, in the front and/or at the rear end of the host vehicle.

Figure 5:
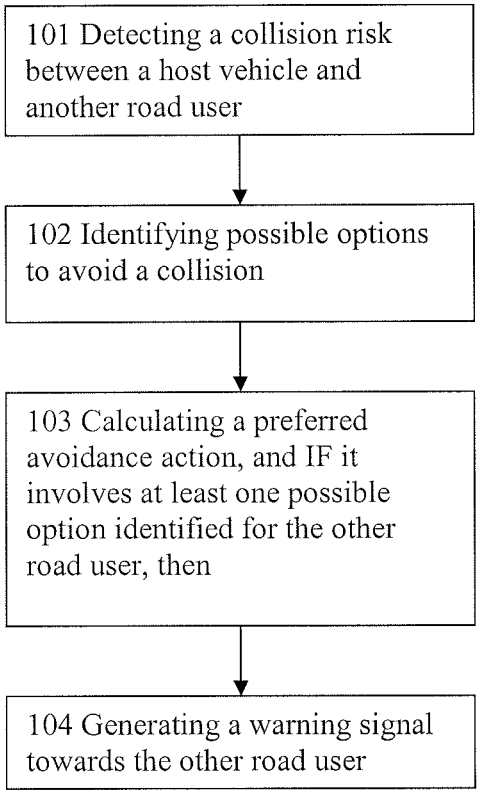
FIG. 5 is a flow chart showing a method according to an embodiment of the present invention.

FIG. 5 is a flow chart showing a method according to the present invention. The method steps in the system for collision warning in a host vehicle will now be described with reference to the flow chart depicted in FIG. 5.

101. Detecting a collision risk between a host vehicle and another user of the road

102. Identifying possible options to avoid a collision

103. Calculating a preferred avoidance action, and if it involves at least one possible option identified for the other user of the road, then

104. Generating a warning signal towards the other user of the road.

According to the method of the present invention, a warning signal 14 is generated towards another user 20, 20*a* of the road, such as another motor vehicle, when an identified option to avoid a collision involves the other user of the road, is calculated to be a preferred avoidance action.

In the detecting step 101 a collision is said to be detected in the detection means 12 if an estimated time to collision falls below a certain threshold. The time to collision is defined as the time to contact between two objects if the current heading angle and velocity of the vehicles remain constant. It should be realized that there are also other ways of defining a collision risk. In the detecting step 101, the sensors 15 collect parameters related to the other user of the road and/or environmental parameters. The parameters are processed in the detecting means 12 and a collision risk may be detected.

In the step of identifying 102 possible options to avoid a collision may include an evaluation in the identifying means 16 of how and/or to which extent the driver of a host vehicle and the other user of the road may be able to brake, steer away and/or accelerate to avoid a collision.

The step of calculating 103 a preferred avoidance action in the calculating means 17, may for example be that the other user of the road steer back into a lane he/she just left, or that the other user or the road brakes and that the host vehicle brakes. Thus, a preferred avoidance action may involve only the other road user or both the other road user and the host vehicle.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method for collision warning in a host vehicle comprising:

detecting a collision risk between the host vehicle and an other user of the road with a detection means based on input from at least one sensor which detects at least one parameter related to the other user of the road with respect to the host vehicle;

identifying possible options to avoid a collision between the host vehicle and the other user of the road based on input from the detection means, wherein possible options for the host vehicle to avoid a collision are identified as well as possible options for the other user of the road to avoid a collision are identified;

calculating among the identified possible options at least one preferred avoidance action in order to avoid a collision between the host vehicle and the other user of the road;

and if the at least one preferred avoidance action involves at least one possible option identified for the other user of the road, then generating a warning signal from the host vehicle in a direction towards the other user of the road in order to warn the other user of the road of the collision risk, the warning signal being sufficient to warn the other user without the other user having to have a transmitter/receiver to process the warning signal.

2. Method for collision warning according to claim 1 further comprising generating the warning signal from the host vehicle in a direction defined from the front, and/or a side of the host vehicle towards the other user of the road.

3. Method for collision warning according to claim 1 further comprising connecting a warning signal generating means arranged with the host vehicle to a calculating means performing the calculating step for providing the warning signal in the form of an audible signal and/or a visible signal.

4. Method for collision warning according to claim 1 further comprising detecting the collision risk between the host vehicle and the other user of the road in a detection means based on input from at least one sensor which detects at least one environmental parameter with respect to the host vehicle.

5. Method for collision warning according to claim 1 further comprising detecting the collision risk between the host vehicle and the other user of the road in a direction defined from the front and/or a side of the host vehicle towards the other user of the road.

6. Method for collision warning according to claim 1 further comprising detecting the collision risk between the host vehicle and the other user of the road in a detection means, wherein the other user of the road is detected to be another motor vehicle, a cyclist or a pedestrian.

7. A system for collision warning in a host vehicle comprising:

a detection means for detecting a collision risk between the host vehicle and an other user of the road based on input from at least one sensor which detects at least one parameter related to the other user of the road with respect to the host vehicle;

an identifying means for identifying possible options to avoid a collision between the host vehicle and the other user of the road based on input from the detection means, wherein possible options for the host vehicle to avoid a collision are identified as well as possible options for the other user of the road to avoid a collision are identified;

a calculating means for calculating among the identified possible options a preferred avoidance action in order to avoid a collision between the host vehicle and the other user of the road; and a warning signal generating means for generating a warning signal from the host vehicle in a direction towards the other user of the road if the preferred avoidance action involves a possible option identified for the other user of the road, the warning signal being understood by the user without further processing once generated by the warning signal generating means.

8. System for collision warning according to claim 7 wherein the warning signal generating means is connected to the calculating means such that a warning signal can be automatically issued if the preferred avoidance action involves a possible option identified for the other user of the road.

9. System for collision warning according to claim 7 wherein the means for generating a warning signal comprises means for providing one of at least an audible signal and a visible signal.

10. System for collision warning according to claim 9 wherein the means for generating an audible warning signal is a horn of the host vehicle.

11. System for collision warning according to claim 9 wherein the means for generating a visible warning signal is at least one of head light, tail light and/or indicator light of the host vehicle.

12. System for collision warning according to claim 9 wherein the means for generating a warning signal are positioned on the host vehicle to direct the warning signal out from the front, a side and/or the rear end of the host vehicle.

13. System for collision warning according to claim 9 wherein the other user of the road is the driver of another motor vehicle, a cyclist or a pedestrian.

14. A method for collision warning comprising:

determining a collision risk between a first vehicle and second vehicle;

determining at least one avoidance action for the second vehicle sufficient to avoid the collision risk with the first vehicle;

facilitating issuance of a warning signal from the first vehicle in a direction towards the second vehicle in order to warn the second vehicle of the collision risk, the warning signal being sufficient to warn a driver of the second vehicle without the second vehicle having to process the warning signal with a transmitter/receiver.

15. The method of claim 14 further comprising directing the first vehicle to implement at least one avoidance action.

16. The method of claim 15 further comprising preventing issuance of the warning signal in the event at least one avoidance action to be implemented by the first vehicle is sufficient to avoid the collision risk.

17. The method of claim 14 further comprising directing the first vehicle to implement at least one avoidance action at the same time as the warning signal is issued to the second vehicle.

18. The method of claim 14 wherein the warning signal is understood by the driver without further electronic processing once issued from the first vehicle.

19. The method of claim 14 wherein each of a left, right, front, and rear side of the first vehicle includes at least one exterior indicator, and wherein the warning signal is issued from each indicator facing in the direction towards the second vehicle.

20. The method of claim 14 wherein the warning signal is in the form of one of an audible signal and a visible signal.

* * * * *